US005557861A

United States Patent [19]

Argouarch et al.

[11] Patent Number: 5,557,861

[45] Date of Patent: Sep. 24, 1996

[54] DEVICE FOR DRYING A MATERIAL IN STRIP FORM, IN PARTICULAR PAPER IN STRIP FORM

[75] Inventors: Jean-Rene Argouarch, Courcouronnes; Dominique X. Brasse, Clamart; Alain J. Grandjean, Evry, all of France

[73] Assignee: Materiels Equipements Graphiques, S.A., Lisses-Evry, France

[21] Appl. No.: 262,992

[22] Filed: Jun. 20, 1994

[30] Foreign Application Priority Data

Jun. 30, 1993 [FR] France ..... 93 07987

[51] Int. Cl.[6] ..... F26B 3/00

[52] U.S. Cl. ..... 34/461; 34/643; 34/656

[58] Field of Search ..... 34/619, 640, 643, 34/653, 655, 656, 461, 464

[56] References Cited

U.S. PATENT DOCUMENTS

| | | | |
|---|---|---|---|
| 3,002,700 | 10/1961 | Mohring | 239/455 |
| 3,462,851 | 8/1969 | Urbas et al. | 34/160 |
| 3,982,327 | 9/1976 | Kurie et al. | 34/643 |
| 4,058,244 | 11/1977 | Vits | 34/640 |
| 5,028,173 | 7/1991 | Vits | 406/86 |

FOREIGN PATENT DOCUMENTS

| | | |
|---|---|---|
| 1054251 | 2/1954 | France . |
| 1149169 | 12/1957 | France . |
| 1551270 | 12/1968 | France . |
| 2284844 | 4/1976 | France . |
| 1097942 | 1/1961 | Germany . |
| 1097943 | 1/1961 | Germany . |
| 3904774 | 5/1990 | Germany . |
| 1517189 | 7/1978 | United Kingdom . |

*Primary Examiner*—F. Daniel Lopez
*Attorney, Agent, or Firm*—Mitchell D. Bittman

[57] ABSTRACT

Device for drying a material in strip form (1), in particular paper in strip form, including on a frame (2) two series ($S_1$, $S_2$) of drying nozzles (3), delimiting in a plane (P) a corridor for the passage of the material in strip form over a path (T), each of the series of drying nozzles being located in a plane ($P_1$, $P_2$) substantially parallel to the plane (P), the drying nozzles being perpendicular to the path of the material, each nozzle comprising at least one narrow, longitudinal slit (4) suitable for allowing a drying gas (5), for example air, to flow therethrough; blocking means are provided for selectively neutralizing a plurality of areas (6) of at least one slit; these means are constituted by at least one comb element (7) positioned in the slit, the comb element comprising a base (8) placed inside the slit and teeth (9) flush with the surface of the slit, the teeth being separated by gaps (10) between which flows the gas escaping through the slit.

10 Claims, 7 Drawing Sheets

DEVICE FOR DRYING A MATERIAL IN STRIP FORM, IN PARTICULAR PAPER IN STRIP FORM

The present invention relates to a device for drying a material in strip form, particularly paper in strip form, including, on a frame, two series of drying nozzles delimiting, in one plane, a corridor for the passage of the material in strip form over a path, each of the series of drying nozzles being located in a plane substantially parallel to the said plane, the drying nozzles being perpendicular to the path of the material, each nozzle comprising at least one narrow longitudinal slit suitable for allowing a drying gas, for example air, to flow therethrough.

Such devices are known, for example those disclosed in UK patent No. 1 443 679 and U.S. Pat. No. 4 768 695.

In the known apparatus, the flow of drying air escapes through slits, generally two in number, provided on the drying nozzles.

This flow of air, whether it be directed perpendicularly or transversely to the plane of travel of the paper in strip form, moves, as a whole, in only two directions, on one hand perpendicularly to the paper and, on the other hand, along the path of travel of the paper.

The air flow thus remains two-way, which has the result of increasing the pressure of the air cushion present between the nozzles and the paper.

The strong air pressure sometimes causes undesirable vibrations on the edges of the paper, which can lead to the paper coming into contact with the nozzles, hence to deposits of ink on the nozzles, which have to be cleaned off, and thus to a drop in productivity.

It is, furthermore, desirable, in this type of installation, to generate considerable movement of the air, so as to increase heat transfer and thus improve the drying of the paper.

In the known devices, if the air pressure is too high, the aforementioned vibrations and drawbacks are observed while if, on the contrary, the air pressure is too low, drying of the paper is incomplete or unevenly distributed over the strip, or the lift applied to the strip is insufficient.

The object of the present invention is remedy these drawbacks and, to do so, there is provided a drying device which is characterized in that blocking means are provided for selectively neutralizing a plurality of areas of at least one slit.

Advantageously, the neutralized areas are evenly distributed along the narrow longitudinal slits of the nozzles.

The presence of the neutralized areas leads to turbulence in the flow of air escaping from the slit or the slits and it thus becomes multi-directional, which increases heat transfer and thus improves drying.

In addition, as a result of reducing the pressure of the air cushion, the impact of the air on the paper is more efficient and further improves heat transfer.

This effect is particularly apparent, on one hand, in the vicinity of the nozzle, but also in the space between two nozzles.

Furthermore, the lateral leakage of air is reduced, which makes it possible to eliminate the effects of flapping or the "flag" effect at the edges of the paper, and thus to avoid paper vibration.

To sum up, the present invention permits the creation of turbulent air flow and multi-directional air jets, which improves the drying of the paper by reason of an increase in heat transfer.

According to a preferred form of embodiment, the drying installation is provided with nozzles which each include two longitudinal slits, and the neutralized areas of the slits of a nozzle are offset.

Advantageously, the neutralized areas of the two slits of a nozzle are staggered.

Provision is also made for the successive neutralized areas of the slits of the nozzles of one or the other, or of both, of the two series of nozzles to be offset according to a given pitch.

These arrangements have the advantage of further improving air flow turbulence, hence drying performance, and of precluding any risk of vibration at the edges of the paper.

According to one particular form of embodiment, the means for blocking a slit are constituted by at least one flat comb element positioned in the slit, the comb element comprising a base placed inside the slit and teeth flush with the surface of the slit, the teeth being separated by longitudinal gaps between which flows the drying gas that escapes through the slit.

The comb elements thus formed are simple to manufacture, the teeth of the comb delimiting the neutralized areas of the slit.

The comb element can be designed with teeth and gaps of regular or constant widths.

Preferably, a single comb element is placed in a slit; the invention can thus be implemented by adding a single comb element in the slit or slits in the nozzles.

Advantageously the ratio of the width of the teeth $L_d$ to the width of the gaps $L_c$ in the comb element is between 0.1 and 10.

The ratio thus determined permits an excellent heat transfer, thus high drying efficiency.

According to one variant, the pitch according to which the successive neutralized areas of the nozzle slits are offset is equal to $(L_d+L_c)/n$, n being a value between 1 and 10.

Tests have shown that these values also enable excellent drying of the strip of paper to be obtained.

This method can be applied either to the slits in one or the other of the series of nozzles, or to all of the nozzle slits of the two series, in the event of each nozzle and each slit in a series being itself laterally offset in relation to the nozzles and slits in the other series.

In certain cases, comb elements of different structures can be used for a slit or for a nozzle, according to drying requirements, or at successive moments.

According to another preferred form of embodiment of the invention, if a longitudinal slit is delimited by the space existing between two substantially parallel longitudinal plates, one inner and one outer, fixed to the nozzle using known means, the neutralized areas are formed by locally stamping the outer plate pressed against the inner plate, the space between two neutralized areas forming a longitudinal window out of which the drying gas flows.

This is an efficient means of producing permanent neutralized areas; this solution has the advantage of being economical, as it does not necessitate the manufacture of a comb element, but it does not permit the setting or changes to the setting, of the size of the neutralized areas. On the hand, it is extremely effective in the case of standardized production.

Advantageously, the ratio of the width $L_n$ of the neutralized areas to the width $L_f$ of the windows is between 0.1 and 10 more specifically 0.3 to 0.7.

It is further possible to design an installation such that the pitch for offsetting the successive neutralized areas of the nozzle slits is equal to $(L_n+L_f)/n$, where n is a value between 1 and 10 more specifically 2 and 5.

As in the case of the comb elements, these values make for excellent drying of the paper strip.

Two forms of embodiment of the present invention will be described herebelow as non-limitative examples with reference to the annexed drawings, wherein.

Figure 1:
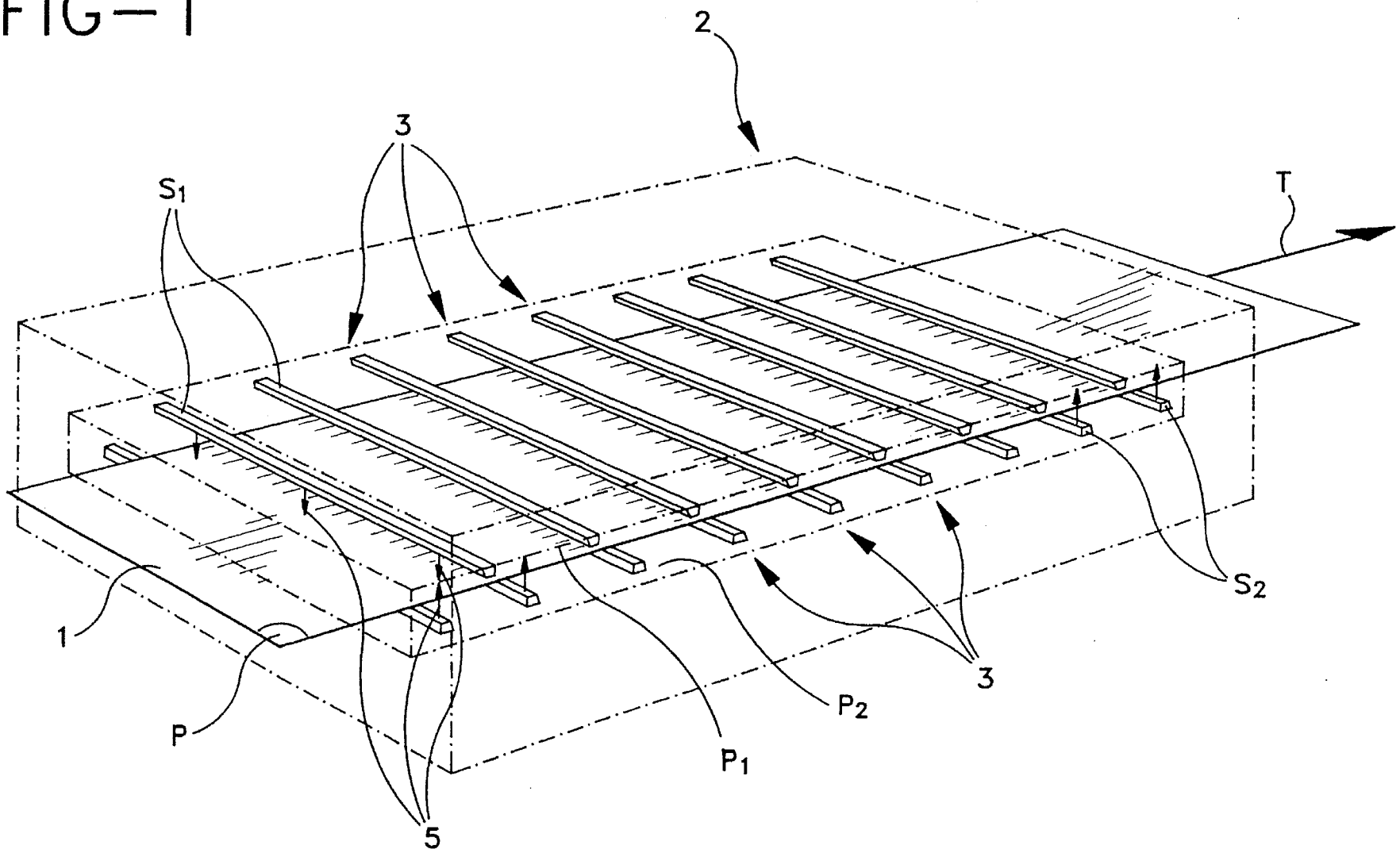
FIG. 1 is a schematic perspective view of a strip paper drier according to the invention.

FIG. 1 represents in dot and dash lines a drier for paper 1 in strip form having the general form of an elongated frame 2, with a length of several meters and a width of approximately 1.5 m, comprising, in particular, an input and an output for the paper.

The latter, driven by means not shown, moves in a plane P inside the drier.

In the frame are disposed a first and a second series $S_1$, $S_2$ of drying nozzles 3, the first series, $S_1$, being located in a plane $P_1$ parallel to the plane of movement of the paper and above the latter, the second series, $S_2$, being located in a plane $P_2$ parallel to the plane of movement of the paper and below the latter.

The series of drying nozzles delimit a corridor for the passage of the paper in strip form over a path T located in the plane P.

The drying nozzles are connected to air blowers, not shown, and their function is to project an air flow 5, for the purpose of drying the paper.

Figure 2A:
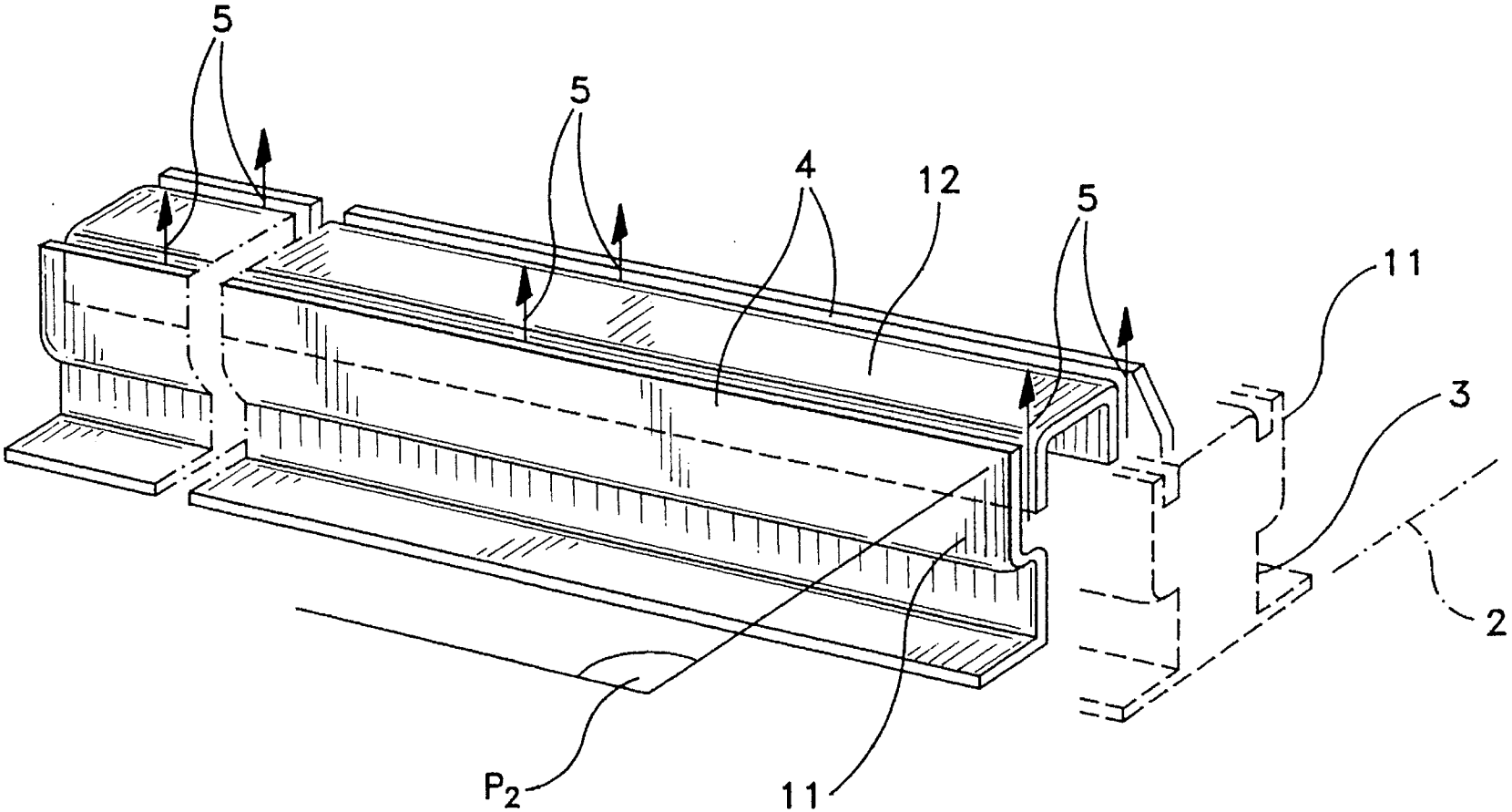
FIG-2A PRIOR ART
FIG. 2 is a partial perspective view of a drying nozzle of the prior art, A, and of two nozzles, B and C, according to the invention.
Figure 2B:
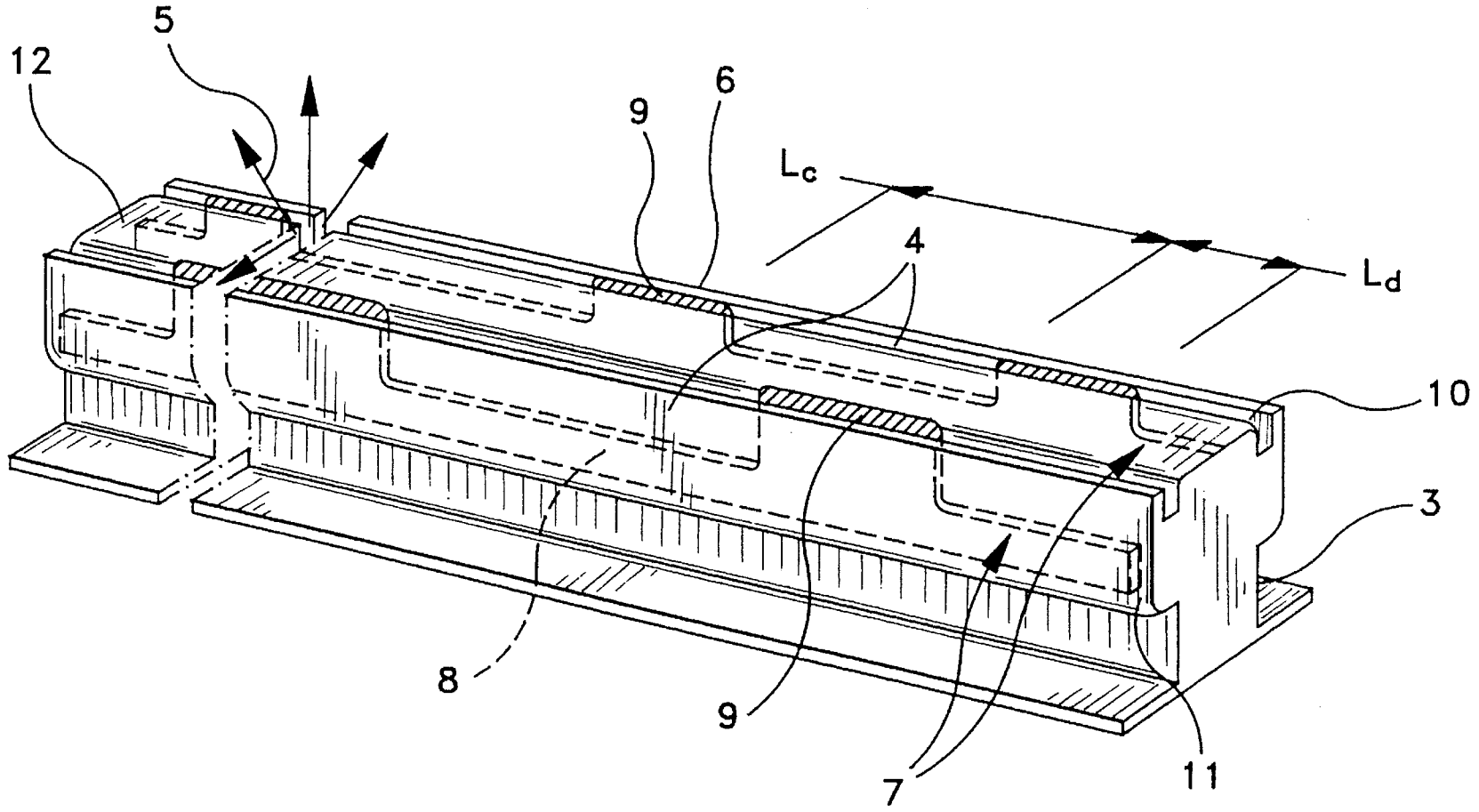
Figure 2C:
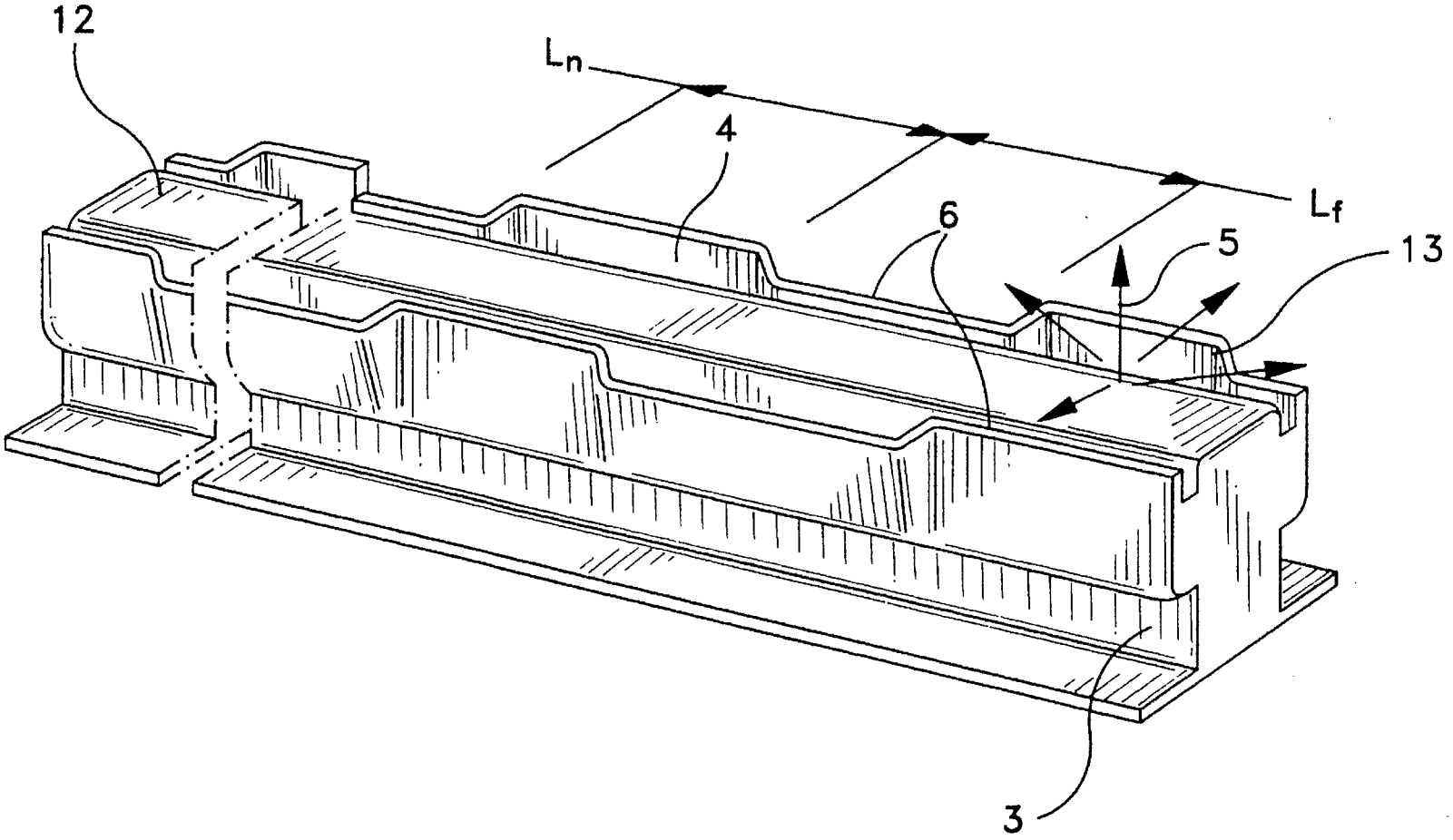
Figure 3A:
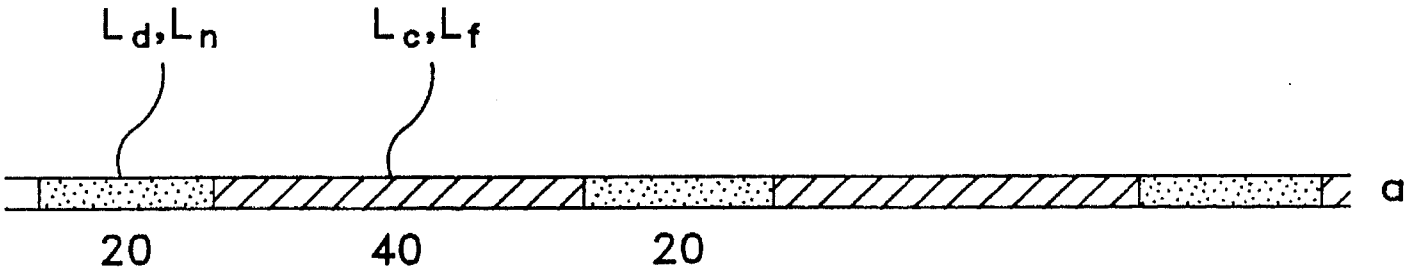
FIG. 3 schematically represents several top views corresponding to different variants of the respective positions of the neutralized areas of the adjacent or neighbouring nozzle slits.
Figure 3B:
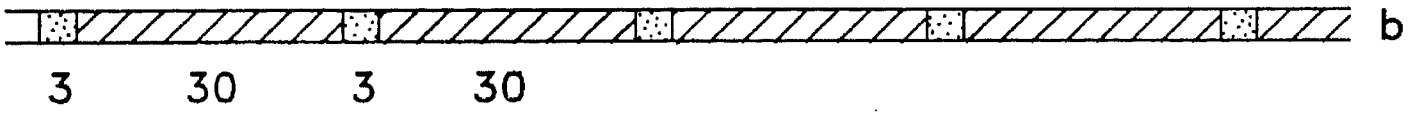
Figure 3C:
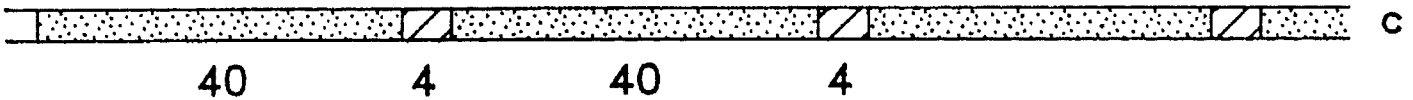
Figure 3D:
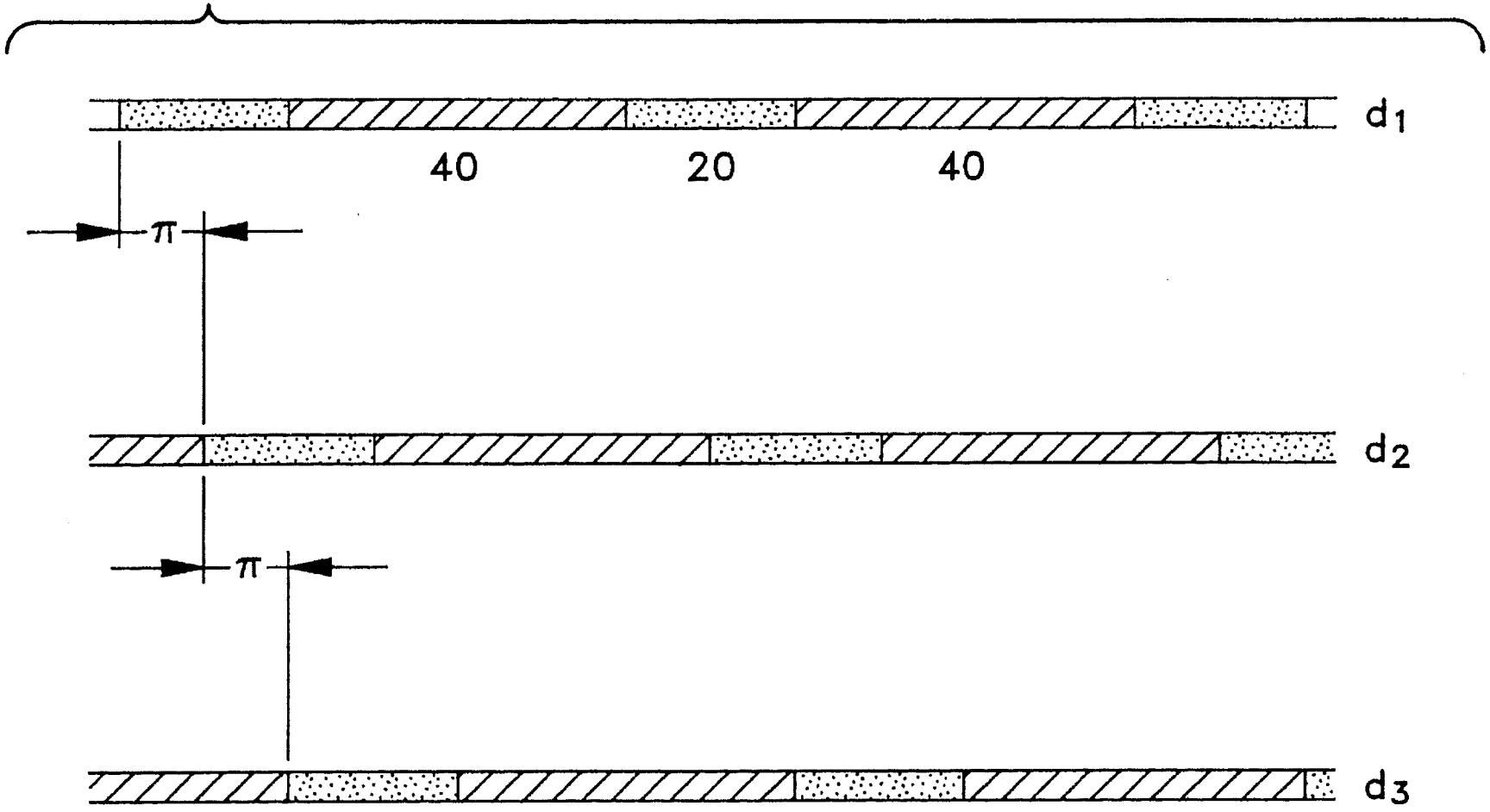
Figure 3E:
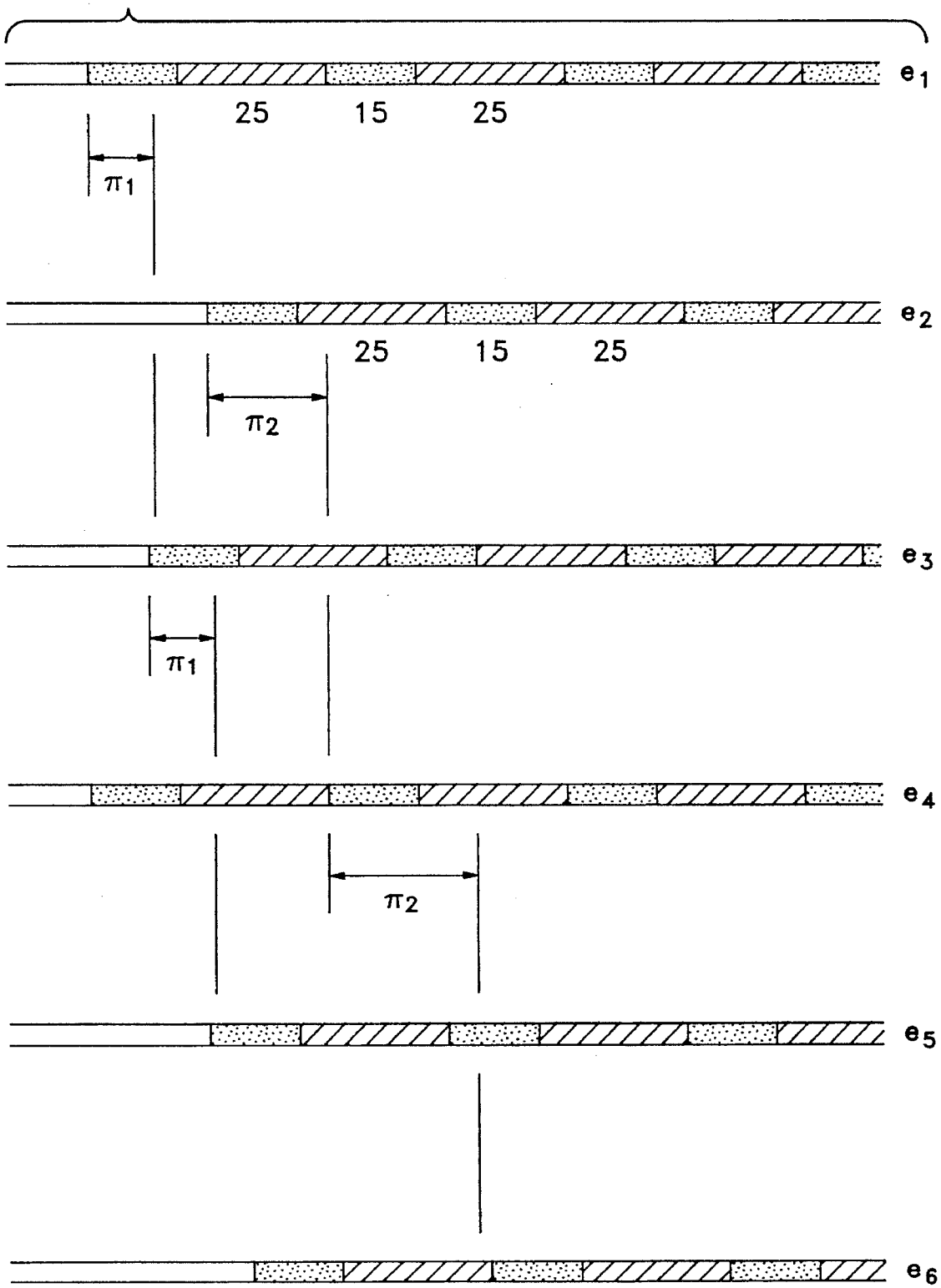

The drying nozzles, which can also be seen in detail in FIG. 2, have an elongated structure, 1.30 m in length, and are disposed perpendicularly to the path of the paper.

The nozzles located in the upper plane $P_1$ are not placed opposite the nozzles located in the lower plane $P_2$; they are, on the contrary, offset in relation to one another and, more precisely, staggered; the result is that the strip of paper alternately receives the air from one nozzle located in the upper plane, and then the air from a nozzle located in the lower plane.

FIG. 2 partially represents a prior art nozzle A and two nozzles, B and C, corresponding to two forms of embodiment of the present invention, in plane $P_2$.

Each nozzle A, B or C comprises two longitudinal outer metal plates 11, a left one and a right one, fixed to the frame, inside which are placed air supply conduits.

In plane $P_2$, and in the area contained between the ends of the right-hand and left-hand outer plates, is fixed an inner plate 12 in the shape of an inverted U, the dimensions of the inner plate being smaller than the distance between the right-hand and left-hand lateral plates, to determine the location of the slits designed to provide the drying air. The ends of the right-hand and left-hand outer plates are located in substantially the same plane as the base of the inverted U-shaped inner plate. The inner plate may be free of any openings.

To make it easier to understand the invention, the known means for fixing the right and left-hand outer plates to the frame and for the inner U-shaped plate have not been shown. In general, these different metallic parts are connected to one another by welded or screwed distance pieces that do not impede the passage of the air, the whole being also welded or screwed onto the frame; this nozzle forming whole has two lateral slits 4, a left and a right-hand one, through which escapes the powerful air flow that dries the paper passing through the apparatus.

The air flow escaping from nozzle A of the prior art is perpendicular to the strip of paper. The pressure that is exerted locally on the width of the strip of paper tends to push it upwards, in the case of the nozzles of series $S_2$, and downwards, in the case of the other nozzles; this causes the paper to undulate, upwards in one case and downwards in the other. At the ends of the nozzle, a leak, parallel to the nozzle and to the plane of the paper gives rise to a "flag" effect, or upward and downward vibrations on the edge of the paper.

On the contrary, drying nozzle B, which represents a form of embodiment of the invention, has the same structure, but, inside each slit 4 has been slid a metallic comb member 7 comprising a thin base 8 placed inside the slit and teeth 9 flush with the surface of each slit in the plane $P_2$, between which teeth are located longitudinal gaps 10 which allow through the air flow; the narrowness of the base is, indeed, such that it does not form an obstacle to the passage of the air.

The width of a tooth $L_d$ is approximately 24 mm, and the width of a gap $L_c$ is approximately 32 mm; thus the ratio $L_d$:$L_c$ is equal to 0.75.

On the nozzle B shown, the comb element placed in one of the slits has been offset laterally in relation to that placed in the other slit, so that a gap is opposite a tooth, and vice versa.

The presence of the teeth results in the formation of neutralized areas 6 which modify the direction of the air upon its exiting from the slit: the air flow, impeded by the obstacles formed by the teeth of the comb, is sent in all directions, indifferently upwards, to the right and the left, forwards and backwards; this multi-directional air flow leads to better drying of the paper, and a high air pressure can be obtained since the effects thereof are distributed; furthermore, owing to the reduction in the pressure of the air cushion and to this multi-directional air flow, the rate of leakage on the edges of the paper is considerably reduced, and "flag" effects are no longer encountered in the vicinity of the edges of the strip.

Nozzle C has the same structure as nozzle A of the prior art, but it will be noted that the right and left-hand outer plates have been locally stamped, with the outer plate thus coming into contact with the inner plate to form neutralized areas distributed along the nozzle; the space contained between two neutralized areas forms a longitudinal window 13; the outer and inner plates are preferably bonded or welded at the contact locations.

The width $L_n$ of the neutralized areas is approximately 50 mm, and the width $L_f$ of the windows is approximately 20 mm; the ratio $L_n$:$L_f$ is equal to 2.5.

It is also noted here that the neutralized areas of the left-hand slit have been made to alternate in relation to those of the right-hand slit, so that the windows are staggered.

FIG. 3 shows top views of several possible arrangements of the neutralized areas for the nozzles of a drier.

The solid lines represent the neutralized areas with a width $L_d$ and $L_n$, respectively, according to whether a comb element or stamped metal plate, respectively, is involved, and the hatched lines represent the gaps or windows respectively with a width $L_c$ and $L_f$, respectively, in the same cases.

Line a shows a slit the neutralized areas ($L_d$, $L_n$) of which are 20 mm wide and the gaps or the windows ($L_c$, $L_f$) of which are 40 mm wide; the ratio $L_d$:$L_c$ or $L_n$:$L_f$ is equal to 0.5.

As to line b, $L_d$ equals $L_n$ equals 3 mm, and $L_c$ equals $L_f$ equals 30 mm, so that $L_d$:$L_c$ equals $L_n$:$L_f$ equals 0.1.

As to line c, on the contrary, $L_d$ equals $L_n$ equals 40 mm and $L_c$ equals $L_f$ equals 4 mm, thus $L_d$:$L_c$ equals $L_n$:$L_f$ equals 10.

In the case of lines $d_1$, $d_2$ and $d_3$, three successive slits of the nozzles in one series are represented, these slits being offset in relation to one another according to a pitch $\pi$ of 10 mm; for values of $L_d$ or $L_n$ of 20 mm, and values of $L_c$ or $L_f$ of 40 mm, the offset $\pi$ of 10 mm is equal to $(L_d+L_c)/n$, or again $(L_n+L_f)/n$, that is to say 60/n, thus n is equal to 6.

Lines $e_1$ to $e_6$ represent the slits in a nozzle located in the upper plane $P_1$ (lines $e_1$, $e_2$), then those of a nozzle that is adjacent but located in the lower plane $P_2$ (lines $e_3$, $e_4$), and then those of the following adjacent nozzle, again located in upper plane $P_1$ (lines $e_5$, $e_6$); in this case, the neutralized areas of lines $e_1$, $e_3$, $e_5$ are offset according to a pitch $\pi_1$ of 10 mm, while the neutralized areas of lines $e_2$, $e_4$, $e_6$ are themselves offset according to a pitch $\pi_2$ of 20 mm; if we have identical values of $L_d$ (or $L_n$) of 15 mm and identical values of $L_c$ (or $L_f$) of 25 mm for all the slits, then:

$\pi_1$ equals 10 mm for $e_1$, $e_3$, $e_5$, thus $n_1$ is equal to 4;

equals 20 mm for $e_2$, $e_4$, $e_6$, thus $n_2$ is equal to 2.

The arrangement of the neutralized areas and of the areas left free can thus be varied both in the case of the slits of the upper nozzles and of those of the lower nozzles, or in the case of the slits of both the upper nozzles and the lower nozzles.

We claim:

1. Device for drying a material in strip form (1), including, on a frame (2), two series ($S_1$, $S_2$) of drying nozzles (3) delimiting, in one plane (P), a corridor for passage of the material in strip form over a path (T), each of the series of drying nozzles being located in a plane ($P_1$, $P_2$) substantially parallel to the plane (P), the drying nozzles being perpendicular to the path of the material, each nozzle comprising two narrow longitudinal slits (4) suitable for allowing a drying gas to flow therethrough, the said longitudinal slit being delimited by a space contained between two substantially parallel longitudinal metal plates, an inner one (12) and an outer one (11) fixed to a nozzle frame, a blocking means being provided to selectively neutralize a plurality of areas (6) of at least one slit, characterized in that the said neutralized areas are areas of the outer plate pressed against the inner plate forming a longitudinal window (13) between the neutralized areas out of which the drying gas flows, characterized in that the neutralized areas of the two slits are offset and staggered.

2. Device for drying a material in strip form according to claim 1, characterized in that the neutralized areas are regularly distributed along the narrow longitudinal slits.

3. Device for drying a material in strip form (1), including, on a frame (2), two series ($S_1$, $S_2$) of drying nozzles (3) delimiting, in one plane (P), a corridor for passage of the material in strip form over a path (T), each of the series of drying nozzles being located in a plane ($P_1$, $P_2$) substantially parallel to the plane (P), the drying nozzles being perpendicular to the path of the material, each nozzle comprising at least one narrow longitudinal slit (4) suitable for allowing a drying gas to flow therethrough, the said longitudinal slit being delimited by a space contained between two substantially parallel longitudinal metal plates, an inner one (12) and an outer one (11) fixed to a nozzle frame, a blocking means being provided to selectively neutralize a plurality of areas (6) of at least one slit, characterized in that the said neutralized areas are areas of the outer plate pressed against the inner plate forming a longitudinal window (13) between the neutralized areas out of which the drying gas flows, characterized in that the offsetting pitch ($\pi$) of the successive neutralized areas of the slits in the nozzles is equal to $(L_n+L_f)/n$, where $L_n$ is the width of the neutralized areas, where $L_f$ is the width of the windows and where n assumes a value between 2 and 5.

4. Device for drying a material in strip form according to claim 3, wherein each nozzle includes two narrow longitudinal slits.

5. Device for drying a material in strip form according to claim 4, characterized in that the neutralized areas of the two slits are staggered.

6. Device for drying a material in strip form according to claim 3, wherein the neutralized areas of the slit have a width ($L_n$) and the windows of the slit have a width ($L_f$) and a ratio of width $L_n$ to width $L_f$ is between 0.1 and 10.

7. Device for drying a material in strip form according to claim 3 wherein the inner metal plate is free of any openings.

8. Device for drying a material in strip form according to claim 3 wherein the material is paper.

9. Device for drying a material in strip form according to claim 3 wherein the drying gas is air.

10. Device for drying a material in strip form (1), including, on a frame (2), two series ($S_1$, $S_2$) of drying nozzles (3) delimiting, in one plane (P), a corridor for passage of the material in strip form over a path (T), each of the series of drying nozzles being located in a plane ($P_1$, $P_2$) substantially parallel to the plane (P), the drying nozzles being perpendicular to the path of the material, each nozzle comprising at least one narrow longitudinal slit (4) suitable for allowing a drying gas to flow therethrough, the said longitudinal slit being delimited by a space contained between two substantially parallel longitudinal metal plates, an inner one (12) and an outer one (11) fixed to a nozzle frame, a blocking means being provided to selectively neutralize a plurality of areas (6) of at least one slit, characterized in that the said neutralized areas are areas of the outer plate pressed against the inner plate forming a longitudinal window (13) between the neutralized areas out of which the drying gas flows, characterized in that the successive neutralized areas of the slits in the nozzles of one or the other, or of both, of the series of nozzles are staggered according to a given pitch ($\pi$).

* * * * *